US006266960B1

(12) United States Patent
Bibb et al.

(10) Patent No.: US 6,266,960 B1
(45) Date of Patent: Jul. 31, 2001

(54) HYDRAULIC CONTROL FOR A QUICK COUPLER

(75) Inventors: John S. Bibb, Apex, NC (US); Paul A. Dvorak, Kewanee, IL (US); Tim A. Green, Peterborough (GB); W. Chris Swick, Raleigh; Peter R. Hildner, Apex, both of NC (US)

(73) Assignee: Caterpillar S.A.R.L., Geneva (CH)

( * ) Notice: Subject to any disclaimer, the term of this patent is extended or adjusted under 35 U.S.C. 154(b) by 0 days.

(21) Appl. No.: 09/250,210

(22) Filed: Feb. 15, 1999

Related U.S. Application Data

(60) Provisional application No. 60/079,703, filed on Mar. 27, 1998.

(51) Int. Cl.[7] ..... F16D 31/02
(52) U.S. Cl. ..... 60/486; 91/165; 91/420
(58) Field of Search ..... 60/486; 91/165, 91/166, 417 R, 419, 420, 442; 414/723

(56) References Cited

U.S. PATENT DOCUMENTS

| | | | | |
|---|---|---|---|---|
| 4,790,084 | | 12/1988 | Anderson et al. | 37/117.5 |
| 4,850,790 | * | 7/1989 | Johnson et al. | 414/723 |
| 5,015,008 | | 5/1991 | Schupback | 280/764.1 |
| 5,049,027 | | 9/1991 | Morrison et al. | 414/723 |
| 5,107,610 | | 4/1992 | Fusco | 37/103 |

FOREIGN PATENT DOCUMENTS

| | | | | |
|---|---|---|---|---|
| 2265601 | | 10/1993 | (GB) | E02F/3/36 |
| 58-121304 | * | 7/1983 | (JP) . | |

* cited by examiner

*Primary Examiner*—Edward K. Look
*Assistant Examiner*—Thomas E. Lazo
(74) *Attorney, Agent, or Firm*—Calvin E. Glastetter

(57) ABSTRACT

Earthmoving machines are often provided with quick coupling devices that allow them to change work implements in a relatively rapid fashion when compared to changing conventionally mounted implements. A locking system between the machine linkage and the implement is positioned between the components and includes a hydraulic system which continually applies pressurized fluid to the locking system.

4 Claims, 1 Drawing Sheet

HYDRAULIC CONTROL FOR A QUICK COUPLER

This application claims the benefit of prior provisional patent application Ser. No. 60/079,703 filed Mar. 27, 1998.

TECHNICAL FIELD

This invention relates generally to a hydraulic control for a quick coupler and more particularly to a hydraulic control which provides a constant pressure on the head of a hydraulic actuator to maintain engagement of the quick coupler.

BACKGROUND ART

In the operation of constructions equipment in recent years there has been a growing trend to utilize machines originally intended for a rather specific task in much more varied applications. In order to accomplish this, hydraulic coupling mechanisms have been developed to allow a machine to mount and utilize more than one implement or tool. It is desirable to be able to quickly detach one tool and attach the next tool using a hydraulic control to latch the implement to the machine and unlatch the implement. While proper measures are available to prevent the unexpected uncoupling of the implement from the machine, there are certain conditions that may cause the connection to loosen slightly and permit the implement to move with respect to the machine during operation. This not only is aggravating to an operator, but it also accelerates the wear of the various components.

The present invention is directed to overcoming one or more of the problems set forth above.

DISCLOSURE OF THE INVENTION

In one aspect of the present invention, a hydraulic control is adapted for use with a coupling to attach an implement to a machine. The hydraulic control includes a hydraulic actuator having a head end and a rod end. The rod end includes a piston rod engageable with the implement to couple the implement to the machine. A first system of pressurized fluid is connected to the head end of the actuator for providing a constant fluid pressure to the head end for engaging and maintaining the piston in engagement with the implement. A second system of pressurized fluid selectively connected to the rod end of the hydraulic actuator for disengaging the piston rod from the implement.

It can therefor be seen that a hydraulic control for a coupling device of this type for an extremely quick transition between implement changes while maintaining a constant hydraulic fluid pressure on the head end of the actuator to latch the implement to the machine.

BEST MODE FOR CARRYING OUT THE INVENTION

Figure 1:
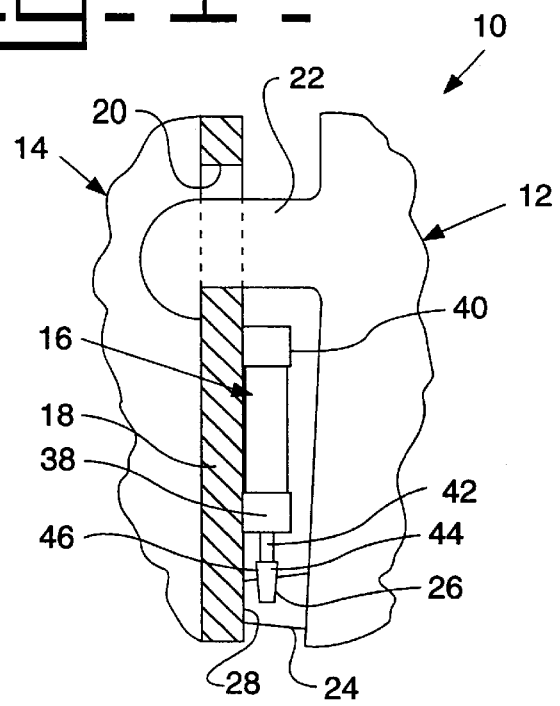
FIG. 1 is a partial side elevational view of a hydraulic actuator and implement that are mounted to one another by a coupling device that embodies the principle of the present invention.

Referring now to the drawings, and more particularly to FIG. 1, a coupling assembly 10 includes a work implement 12 and a linkage arrangement 14 of a machine (not shown) and a hydraulic actuator 16 therebetween. The linkage arrangement 14 includes a mounting plate 18 having an aperture 20. The implement includes a mounting member 22 which interacts with the aperture 20 for attaching the implement. The implement also includes an attachment block 24 having a v-shaped groove 26. The attachment block 24 has a surface 28 which contacts the mounting plate 18 when the implement 12 is attached to the linkage arrangement 14. While it is to be understood that this device could be used on a number of different machine for illustration purposes, it is disclosed and described herein as being associated with a wheel loader.

Figure 2:
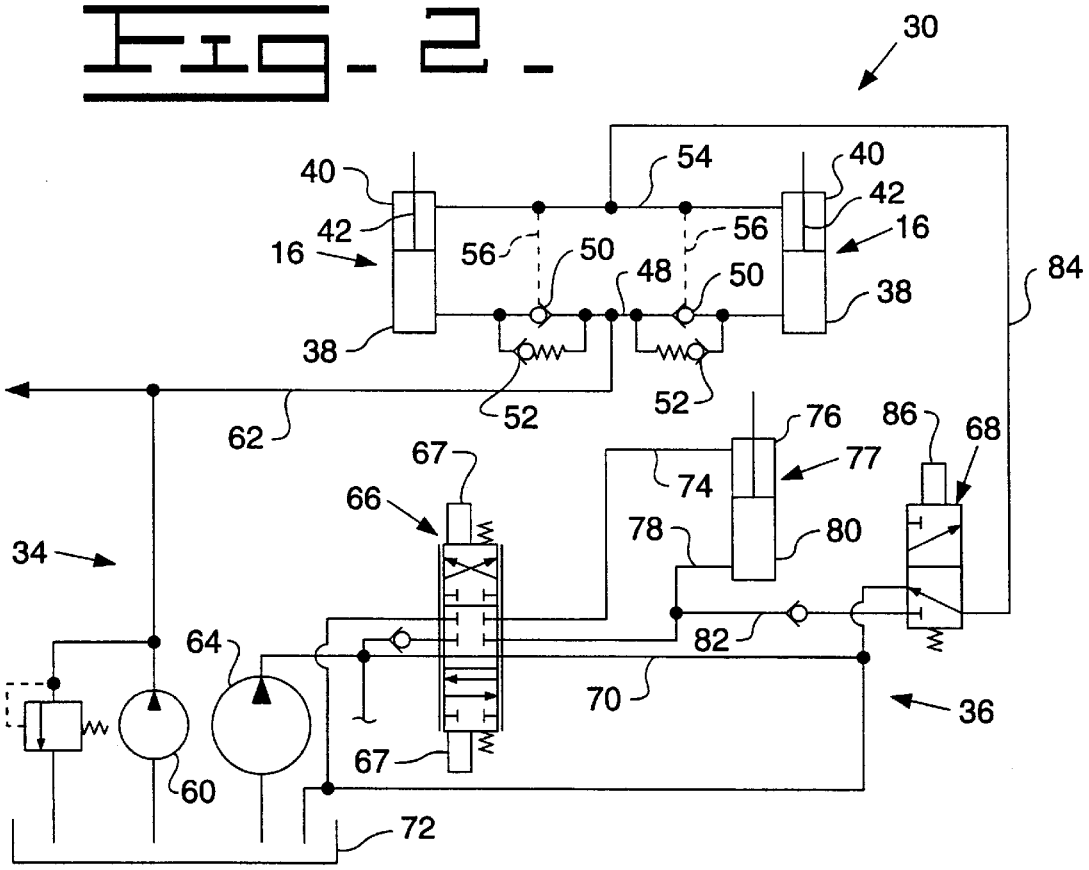
FIG. 2 is a schematic diagram of the hydraulic control utilized in the operation of the present invention.

Referring to FIGS. 1 and 2 a hydraulic control system 30 is provided for holding the implement 12 in position relative to the linkage arrangement 14. The hydraulic control system 30 includes the hydraulic actuators 16, a first pressurized fluid system 34, and a second pressurized fluid system 36.

Each of the hydraulic actuators have a head end 38, a rod end 40 and a piston rod 42. The piston rod 42 has a rod end wedge member 44 having inclined surfaces 46 which interact with the v-shaped groove 26 in the attachment block 24 to lock the implement in position. The head ends 38 of the actuators are connected together by a conduit 48. A pair of pilot operated check valves 50 are positioned in the conduit 48 and a thermal check valve 52 is connected to the conduit 48 on opposite sides of the pilot operated check valve 50. The rod ends 40 of the actuators are connected together by a conduit 54. A pilot line 56 extends from the conduit 54 to open the pilot operated check valve 50 when the conduit 54 is pressurized.

The first pressurized fluid system 36 includes a first pump 60 for supplying pressurized fluid through a conduit 62 to the conduit 48 connected to the head end 38 of the actuator 16. The first pump 60 supplies a constant source of fluid at a predetermined pressure to the head end of the actuator.

The second pressurized fluid system 36 includes a second pump 64, a three position solenoid operated spring centered valve 66, and a two position solenoid operated spring returned valve 68 for selectively supplying pressurized fluid at a predetermined pressure to the rod end of the actuator. The predetermined pressure of the second fluid system 36 is greater than the predetermined pressure of the first fluid system 34. The valve 66 has a first or centered position at which fluid is directed through a conduit 70 to a tank 72, a second position at which fluid is directed through a conduit 74 to a rod end 76 of a implement hydraulic actuator 77, and a third position at which fluid is directed through a conduit 78 to a head end 80 of the implement actuator 77 and through a conduit 82 to the valve 68. The valve 66 includes solenoids 67 for receiving a control signal, not shown, for shifting the valve 66 from the first position to the second and third positions. The valve 68 has a first spring biased position at which fluid flow from the conduit 82 is blocked and a second position at which fluid from the conduit 82 is directed through a conduit 84 to the conduit 54 for distribution to the rod ends of the actuators 16. The valve 68 includes a solenoid 86 for receiving a control signal, not shown, for shifting the valve 68 from the first position to the second position.

INDUSTRIAL APPLICABILITY

In the use of manipulating a work implement 12 of a machine in normal fashion, the condition of the hydraulic control is illustrated. In this condition, the pressurized fluid from the first pump 60 is constantly directed to the head end 38 of the actuator 16 by conduits 62,48. The pressure to the head end urges and maintains the piston rod 42 into engagement with the block 24. Since the wedge member 44 is directly connected to the piston rod, the fluid pressure is translated into a force that continually urges the angled surfaces into engagement to insure a solid connection at all times during operation of the implement. The valve 66 is in the spring centered position and the valve 68 is biased to the first position blocking fluid flow to the rod ends 40 of the actuators 16.

When the operator decides to remove or change the implement the solenoid 67 is energized to move the valve 66 to its third position and at the same time the solenoid 86 is energized to move the valve 68 to its second position. With the valves 66,68 shifted fluid in the second system of pressurized fluid is allowed to flow into the rod ends 40 of the actuators 16. The pilot lines 56 will open the check valves 50 to allow fluid to drain from the head ends 38 of the actuators 16. Since the pressure in the second system is greater than the pressure in the first system the piston rod will retracted to disconnect the wedge member 44 from the v-shaped block 24. The fluid from the head end will flow through the check valves 50 to the drain or other attachment. With the actuator disconnected from the implement the implement can be removed and changed. To reattach the implement the mounting member 22 is positioned into the aperture 20 and pivots until the attachment block 24 contacts the linkage to limit movement. With the implement in position the solenoids 67,86 are denergized and the valves 66,68 are biased to their neutral position to block fluid flow to the rod ends of the actuators. Without pressure in the rod ends the first pressure system will again act on the head end to extend the piston rod and again lock the implement to the linkage. The thermal check valves 52 are set to open if the temperature increases to a predetermined value Other aspects, objects and advantages of this invention can be obtained from a study of the drawings, the disclosure and the appended claims.

What is claimed is:

1. A hydraulic control adapted for use with a coupling for attaching an implement to a machine, the hydraulic control comprising:

a hydraulic actuator having a head end and a rod end, the rod end includes a piston rod engageable with the implement to couple the implement to the machine;

a first system of pressurized fluid being connected to the head end of the actuator for providing a constant fluid pressure to the head end of the actuator for engaging and maintaining the piston in engagement with the implement the first system includes a first pump providing a first predetermined fluid pressure to the head end of the hydraulic actuator;

a second system of pressurized fluid selectively connected to the rod end of the actuator for disengaging the piston rod from the implement the second system includes a second pump providing a second predetermined fluid pressure to the rod end of the hydraulic actuator, the second predetermined fluid pressure being greater than the first predetermined fluid pressure;

a check valve being actuated by a pilot signal from the second system of pressurized fluid; and a thermal check valve having one side connected between the first pump and the pilot actuated check valve and a second end connected between the pilot actuated check valve and the head end of the hydraulic actuator.

2. The hydraulic control of claim 1, includes a valve means for selectively connecting the second pressurized system to the rod end of the hydraulic actuator for disengaging the piston rod from the implement.

3. The hydraulic control of claim 2, wherein the valve means includes a solenoid actuated three position valve and a solenoid actuated two position valve.

4. The hydraulic control of claim 3, wherein the hydraulic actuator is vertically positioned between the linkage and the implement when in use.

* * * * *